US005087104A

United States Patent [19]

Fursier et al.

[11] Patent Number: 5,087,104

[45] Date of Patent: Feb. 11, 1992

[54] CLOSURE FOR A THREE-PART CONTROL CABINET

[75] Inventors: Roger Fursier, Cornwall, Great Britain; Claus-Dieter Bovermann, Breitenbach-Niederdieten, Fed. Rep. of Germany

[73] Assignee: Rittal-Werk Rudolf Loh GmbH & Co. KG, Fed. Rep. of Germany

[21] Appl. No.: 600,773

[22] Filed: Oct. 8, 1990

[30] Foreign Application Priority Data

Oct. 6, 1989 [EP] European Pat. Off. ..... 89118547

[51] Int. Cl.[5] ..... A47B 47/00

[52] U.S. Cl. ..... 312/100

[58] Field of Search ..... 312/329, 291, 100; 70/DIG. 65

[56] References Cited

U.S. PATENT DOCUMENTS

| | | | |
|---|---|---|---|
| 525,906 | 9/1894 | Johnson | 70/DIG. 65 |
| 2,126,134 | 8/1938 | Palley et al. | 312/291 X |
| 3,287,079 | 11/1966 | Courson | 312/291 |

FOREIGN PATENT DOCUMENTS 947444 8/1956 Fed. Rep. of Germany .

*Primary Examiner*—Joseph Falk
*Attorney, Agent, or Firm*—Speckman & Pauley

[57] ABSTRACT

A closure for a three-part control cabinet having a base cabinet, a pivot frame and an inspection window box with a lock plate having a first lock element positioned in the front of the inspection window box. Manipulation of the closure from the front of the control cabinet is only achieved when the activation element of the first lock element is coupled, fixed against relative torsion, with a first catch insert which is rotatably seated at the back of the inspection window box. The activation element has a locking projection and can be inserted into a first catch retainer, fastened to the front of the pivot frame, and can be secured therein by rotating it. Subsequent to the first catch retainer, the front of the pivot frame has a first bearing retainer for a second lock element, the activation element of which is coupled, fixed against relative rotation with a driving bar. The driving bar is connected with a second catch insert, which is rotatably seated in a second bearing receptacle in the back of the pivot frame. The second catch insert can be inserted with its locking projection into a second catch retainer positioned on the front of the base cabinet and can be secured therein by rotating it.

20 Claims, 3 Drawing Sheets

CLOSURE FOR A THREE-PART CONTROL CABINET

FIELD OF THE INVENTION

This invention relates to a closure for a three-part control cabinet having a base cabinet, a pivot frame and an inspection window box with a lock plate which has a first lock element positioned in the front of the inspection window box.

SUMMARY OF THE INVENTION

The connection between the inspection window box and the pivot frame can be released with the first lock element, so that the inspection window box, which is hinged on the pivot frame, can be pivoted. The pivot frame, which is hinged on the base cabinet, can be brought into the closed position with a further closure. In most cases this closure is positioned in an area of separation between the pivot frame and the base cabinet and therefore it is hard to gain access to it, particularly where a plurality of control cabinets are positioned side-by-side and fastened on a wall.

It is one object of this invention to provide a closure of the type mentioned above which allows easy release of the connection between the inspection window box and the pivot frame as well as the release of the connection between the pivot frame and the base cabinet, even if the control cabinet is only accessible from the front.

In accordance with this invention, this object is achieved in that the activation element of the first lock element is coupled, fixed against relative torsion, with a first catch insert which is rotatably seated at a back of the inspection window box and which is provided with a locking projection, and can be inserted into a first catch retainer, fastened to the front of the pivot frame, and can be secured therein by twisting it. Subsequent to the first catch retainer, the front of the pivot frame has a first bearing retainer for a second lock element, the activation element of which is coupled, fixed against relative torsion, with a driving bar. The driving bar is connected with a second catch insert, which is rotatably seated in a second bearing receptacle in the back of the pivot frame. The second catch insert can be inserted with its locking projection into a second catch retainer positioned on the front of the base cabinet and can be secured therein by twisting it.

The first catch retainer at the pivot frame and the catch insert in the inspection window box provide the connection between the inspection window box and the pivot box. In the simplest case, the rotating movement for the catch insert is performed by means of the activation element of the first lock element, which can be operated with a key. When the inspection window box has been pivoted away from the pivot frame, the second lock element, which is positioned in the first bearing retainer, is accessible through the first catch retainer in the area of the front of the pivot frame. The driving bar can be twisted with the activation element of the second lock element, which also displaces the second catch insert, which is rotatably seated in the second bearing retainer in the area of the back of the pivot frame and which, together with the second catch retainer in the area of the front of the base cabinet, makes or releases the connection between the pivot frame and the base cabinet. The second locking element is always accessible when the inspection window box is open and pivoted outward. Therefore the control cabinet need only be accessible from the front.

In another advantageous embodiment according to this invention, the first lock element in the lock plate and the second lock element in the first bearing retainer of the pivot frame are designed the same. If both lock elements are designed for key actuation, then it is possible to use one and the same key for releasing the inspection window box on the pivot frame, and the pivot frame on the base cabinet, for pivoting and for preventing such pivoting.

To keep the required number of different components within reason, the first locking insert in the inspection window box and the second catch insert in the second bearing retainer of the pivot frame are designed in the same way, and the first catch retainer on the pivot frame and the second catch retainer on the base cabinet are designed in the same way.

Furthermore, the closure design can be simplified by the first bearing retainer for the second locking element and the second bearing retainer for the second catch insert being designed in the same way.

For a coupling, fixed against relative rotation, between the actuation element of the second locking element in the pivot frame and the driving bar, in one embodiment, the actuation element of the second locking element is connected, fixed against relative rotation, with a driving sleeve which receives a rectangular retainer element fixed against relative rotation. The driving bar, which is round in cross section, is non-rotatively connected with the rectangular retainer element.

In another embodiment, if the first catch retainer is fastened on the outside of a wall which forms the front of the pivot frame, together with the first bearing retainer for the second locking element fastened on the inside of the same wall, then the assembly effort can be reduced.

Insertion of and locking the catch inserts in th locking retainers is thus simplified and is accomplished by the first and the second catch retainers each having a retainer sleeve with a conically widening insertion opening and by the retainer sleeves merging into a fastening plate with fastening bores through a catch shoulder for the locking projection of the catch insert.

It is possible to produce higher torque for turning the first catch insert if the first catch insert in the inspection window box is coupled with a turning handle which can be pivoted in and out of the inspection window box. The turning handle is maintained in a pivoted-in position against the effect of a spring with a rotatably seated trigger. A toggle lever, controllable with a locking cylinder, releases the trigger and thus the turning handle, only in the open position of the locking cylinder. The turning handle can only be grasped after the locking cylinder has opened, since the spring automatically pivots the turning handle out. When the locking cylinder is moved into the closed position, the turning handle can be pivoted in and locked.

This invention will be described in detail by means of various embodiments shown in the drawings.

DESCRIPTION OF PREFERRED EMBODIMENTS

Figure 1:
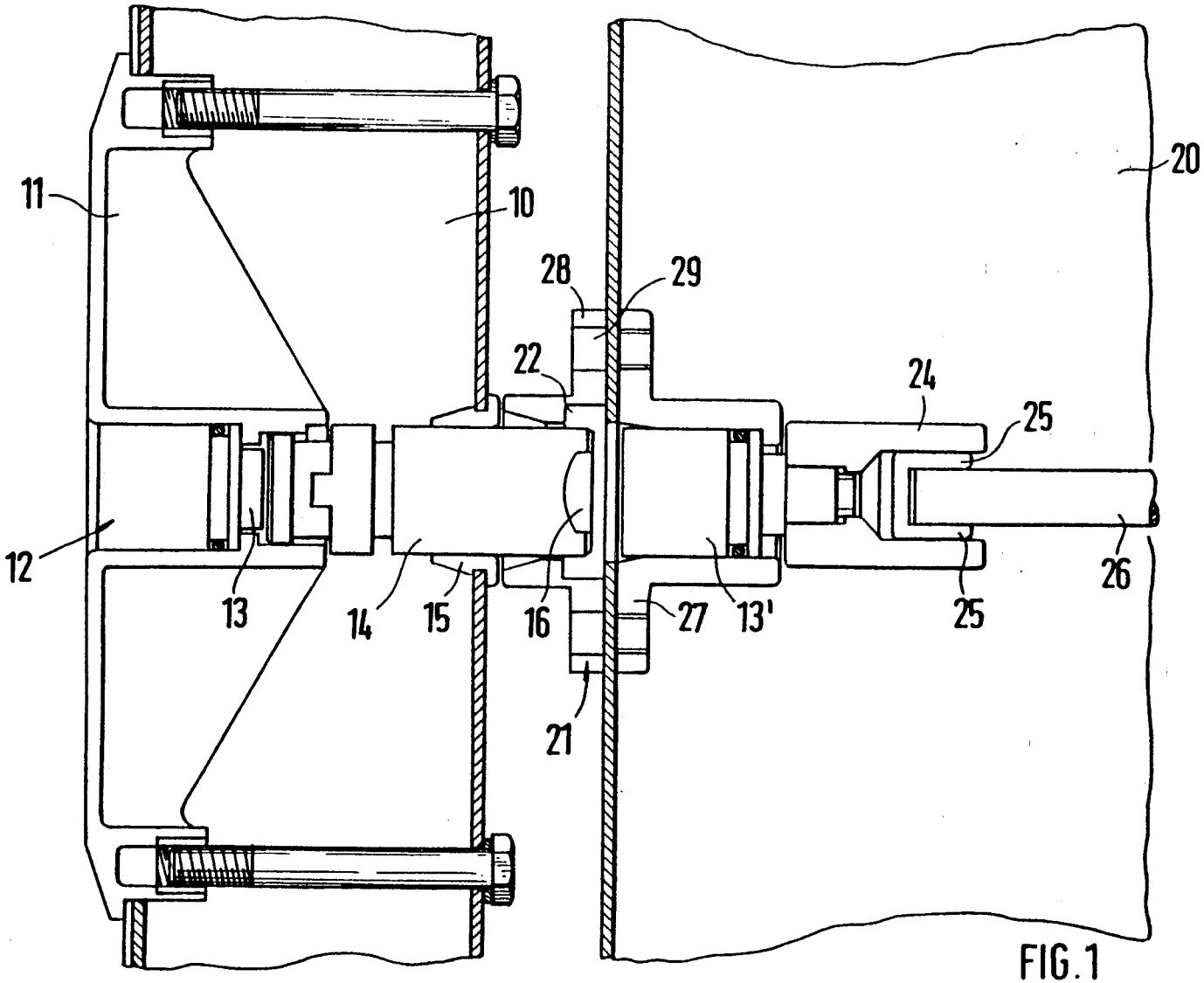
FIG. 1 is a cross-sectional view of a portion of the closure, between the inspection window box and the pivot frame.

As shown in FIG. 1, the inspection window frame 10 is positioned in front of the pivot frame 20 and is hinged to it in a manner not shown, so that the inspection window frame 10 can be pivoted with respect to the pivot frame 20. The hinge side is in the area of the one vertical side and the closure is in the area of the other vertical side of the control cabinet.

The lock plate 11 is inserted into the front 12 of the inspection window box 10 and receives the first lock element 13, the activation element of which can be rotatably moved with a key. The first catch insert 14 is rotatably seated, as shown by the bearing bushing 15, in the area of the back of the inspection window box 10, shown as a wall. The first catch insert 14 is coupled, fixed against relative rotation, with the activation element of the first lock element 13, so that they are turned together. The first catch insert 14 contains the locking projection 16 and is inserted into the first catch retainer 21, positioned in the area of the front of the pivot frame 20, when the inspection window box 10 is pivoted inward. This first catch retainer 21 has a retainer sleeve with a conically diverging insertion opening. While forming the first catch shoulder 22 for the locking projection 16 of the first catch insert 14, the retainer sleeve merges into the fastening plate 28 which has the fastening bores 29. When the first catch insert 14 is rotated, either the locking projection 16 is clamped behind the catch shoulder 22 of the first catch retainer 21, or the first catch insert 14 with the locking projection 16 is released for pivoting the inspection window box 10 outward.

Together with the first catch retainer 21, the first bearing retainer 27 is also positioned on the front of the pivot frame 20. Because the catch retainer 21 is fastened on the outside and the bearing retainer 27 on the inside of the wall of the pivot frame 20 which forms the front, it is possible to use common fastening screws. After pivoting the inspection window box 10 away, the front of the pivot frame 20 opens and provides access to the second lock element 13', which is retained in the first bearing retainer 27. The activation element of the second lock element 13' is connected, fixed against relative rotation, with the driving sleeve 24. The driving sleeve 24 receives the rectangular retainer element 25, in which the round driving bar 26 is non-rotatably fixed. The driving bar 26 is also rotated along with the rotation of the activation element of the second lock element 13'.

Figure 2:
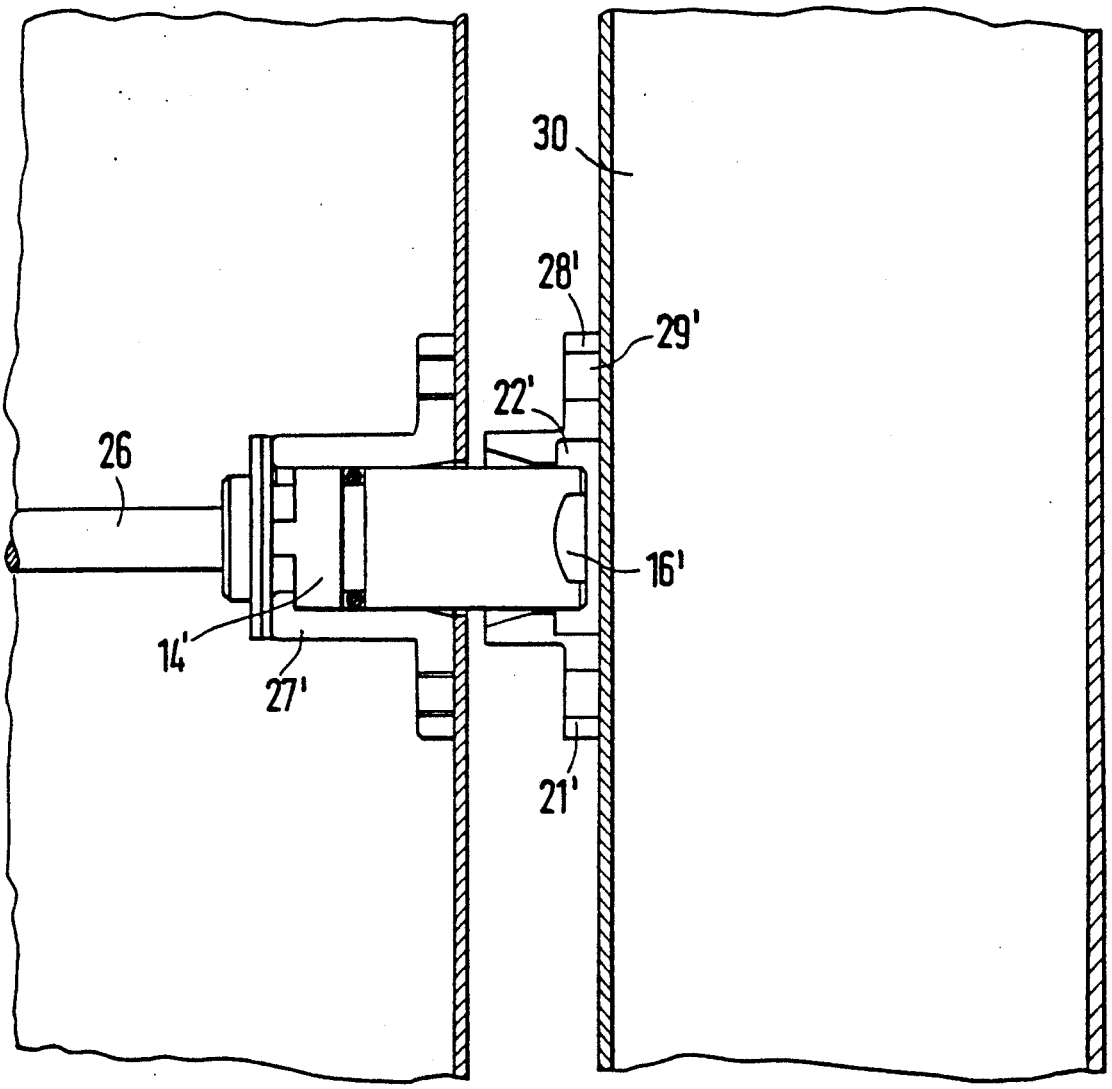
FIG. 2 is a cross-sectional view of another portion of the closure, the pivot frame and the base cabinet.

As shown in FIG. 2, the driving bar 26 extends as far as the back of the pivot frame 20 and is non-rotatably coupled there with the second catch insert 14', which is designed in the same way as the first catch insert 14. The second catch insert 14' is rotatably seated in the second bearing retainer 27', which is designed the same as the first bearing retainer 27 for the second lock element 13'. The second catch retainer 21', which receives the second catch insert 14', is positioned at the front of the base cabinet 30. During rotation, the locking projection 16' provides the connection between the pivot frame 20 and the base cabinet 30, or releases the second catch insert 14' for moving the second catch retainer 21' out, so that the pivot frame 20 can be pivoted with respect to the base cabinet 30. The fastening plate 28', which has the fastening bores 29', is used to fasten the second catch retainer 21' to the wall which forms the front of the base cabinet 30.

Figure 3:
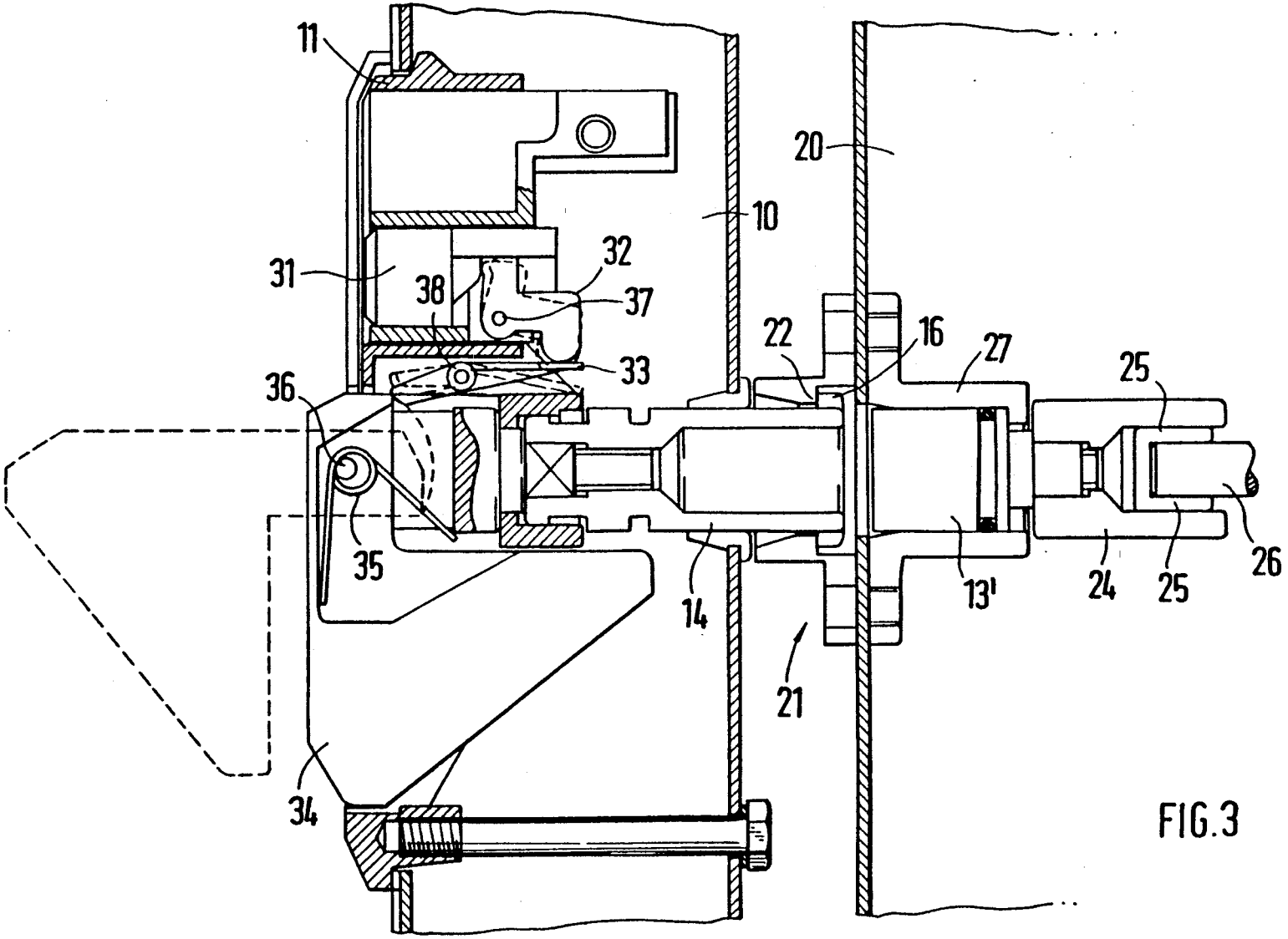
FIG. 3 is a cross-sectional view of a further embodiment of the closure in the inspection window box.

FIG. 3 shows another embodiment of the portion of the closure in the area of the inspection window box 10. The coupling of the first catch insert 14 at the back of the inspection window box 10, with the first catch retainer 21 on the front of the pivot frame 20, remains the same. The lock plate 11 is different from the previously described embodiments and now receives the turning handle 34, which is pivotal about the bearing shaft 36 and is subjected to the action of the spring 35. The turning handle 34 is connected, fixed against relative rotation, with the first catch insert 14 with a coupling element. Above the turning handle 34, the lock plate 11 receives the locking cylinder 31, the actuation element of which controls the toggle lever 32, which is rotatable around the shaft 37. In turn, the toggle lever 32 actuates the trigger 33, rotatable around the shaft 38, which maintains the turning handle 34 in the pivoted-in position, as long as the locking cylinder 31 is in a locked position. If the locking cylinder 31 is brought into an opened position, its actuation element pivots the toggle lever 32 into the position shown by dashed lines. In the course of such movement, the trigger 33 is also displaced and releases, in the position shown by dashed lines, the turning handle 34, which is moved into the pivoted-out position by the spring 35. For releasing the closure between the inspection window box 10 and the pivot frame 20, the turning handle 34 is easy to grasp and turn. When the locking cylinder 31 is turned back into the locked position, the turning handle 34 can be pivoted in and the trigger 33 fixes it in this position, because it is released by the toggle lever 32 and again takes up its initial position.

It is also possible to design the inspection window box 10 and/or the base cabinet 30 in the form of cabinet doors, which are hinged to the pivot frame 20 and can be moved into a locked position with it.

What is claimed is:

1. A closure for a three-part control cabinet having a base cabinet, a pivot frame and an inspection window box, said inspection window box having a front window box wall and a lock plate having a first lock element positioned in said front window box wall, the closure comprising:

a first activation element of said first lock element (13) coupled and fixed against relative rotation with a first catch insert (14) which is rotatably seated at a back portion of said inspection window box, said first activation element having a first locking projection (16) insertable within a first catch retainer (21), said first catch retainer (21) fastened to a front pivot frame wall of said pivot frame (20), said first locking projection (16) securable within said first catch retainer (21) by rotating said first activation element;

a first bearing retainer (27) fastened on said front pivot frame wall opposite said first catch retainer (21), a second lock element (13') rotatably seated within said first bearing retainer (27), a second actuation element of said second lock element (13') coupled and fixed against relative rotation with a driving bar (26);

said driving bar (26) connected with a second catch insert (14') which is rotatably seated in a second bearing retainer (27') in a back pivot frame wall of said pivot frame (20); and said second catch insert (14') having a second locking projection (16') which can be inserted into a second catch retainer (21') positioned on a front base cabinet wall of a base cabinet (30) and can be secured therein by rotating said second locking projection (16').

2. A closure in accordance with claim 1, wherein said first lock element (13) and said second lock element (13') are interchangeable.

3. A closure in accordance with claim 2, wherein said first catch insert (14) and said second catch insert (14') are interchangeable.

4. A closure in accordance with claim 3, wherein said first bearing retainer (27) and said second bearing retainer (27') are interchangeable.

5. A closure in accordance with claim 4, wherein said first catch retainer (21) and said second catch retainer (21') are interchangeable.

6. A closure in accordance with claim 5, wherein a key is used to move said first lock element (13) and said second lock element (13') between a locked position and an opened position.

7. A closure in accordance with claim 6, wherein said second actuation element of said second lock element (13') is connected, fixed against relative rotation, with a driving sleeve (24) which receives a rectangular retainer element (25) fixed against rotation relative to said driving sleeve (24), and said driving bar (26) has a round cross section and is non-rotatably connected with said rectangular retainer element (25).

8. A closure in accordance with claim 7, wherein said first catch retainer (21) is fastened on an outside surface of said front pivot frame wall and said first bearing retainer (27 is fastened on an inside surface of said front pivot frame wall.

9. A closure in accordance with claim 8, wherein said first and said second catch retainers (21, 21') have a retainer sleeve with a conically diverging insertion opening, and each said retainer sleeve merges into a fastening plate (28, 28') having fastening bores (29, 29') and forming a catch shoulder (22, 22') for each of said first and said second locking projection (16, 16') of said first and said second catch inserts (14, 14').

10. A closure in accordance with claim 9, wherein said first catch insert (14) is coupled with a turning handle (34) which is pivotal in and out of said inspection window box (10), said turning handle (34) is maintained in a pivoted-in position against a force of a spring (35) by a rotatably seated trigger (33), and a toggle lever (32), controllable by means of a locking cylinder (31), releases said trigger (33) and said turning handle (34) only in an open position of said locking cylinder (31).

11. A closure in accordance with claim 10, wherein at least one of said inspection window box (10) and said base cabinet (30) is in form of a cabinet door which is hinged to said pivot frame (20) and ca be moved into a locked position with said pivot frame (20).

12. A closure in accordance with claim 1, wherein said first catch insert (14) and said second catch insert (14') are interchangeable.

13. A closure in accordance with claim 1, wherein said first bearing retainer (27) and said second bearing retainer (27') are interchangeable.

14. A closure in accordance with claim 1, wherein said first catch retainer (21) and said second catch retainer (21') are interchangeable.

15. A closure in accordance with claim 1, wherein a key is used to move said first lock element (13) and said second lock element (13') between a locked position and an opened position.

16. A closure in accordance with claim 1, wherein said second actuation element of said second lock element (13') is connected, fixed against relative rotation, with a driving sleeve (24) which receives a rectangular retainer element (25) fixed against rotation relative to said driving sleeve (24), and said driving bar (26) has a round cross section and is non-rotatably connected with said rectangular retainer element (25).

17. A closure in accordance with claim 1, wherein said first catch retainer (21) is fastened on an outside surface of said front pivot frame wall and said first bearing retainer (27) is fastened on an inside surface of said front pivot frame wall.

18. A closure in accordance with claim 1, wherein said first and said second catch retainers (21, 21') have a retainer sleeve with a conically diverging insertion opening, and each said retainer sleeve merges into a fastening plate (28, 28') having fastening bores (29, 29') and farming a catch shoulder (22, 22') for each of said first and said second locking projection (16, 16') of said first and said second catch inserts (14, 14').

19. A closure in accordance with claim 1, wherein said first catch insert (14) is coupled with a turning handle (34) which is pivotal in and out of said inspection window box (10), said turning handle (34) is maintained in a pivoted-in position against a force of a spring (35) by a rotatably seated trigger (33), and a toggle lever (32), controllable by means of a locking cylinder (31), releases said trigger (33) and said turning handle (34) only in an open position of said locking cylinder (31).

20. A closure in accordance with claim 1, wherein at least one of said inspection window box (10) and said base cabinet (30) is in a form of a cabinet door which is hinged to said pivot frame (20) and can be moved into a locked position with said pivot frame (20).

* * * * *